US009204725B2

(12) United States Patent
Kania et al.

(10) Patent No.: US 9,204,725 B2
(45) Date of Patent: Dec. 8, 2015

(54) ROCKER-EQUIPPED HUNTING BLIND

(71) Applicants: Bruce G. Kania, Shepherd, MT (US); Frank M. Stewart, Bozeman, MT (US); David William Ewald, Wonder Lake, IL (US)

(72) Inventors: Bruce G. Kania, Shepherd, MT (US); Frank M. Stewart, Bozeman, MT (US); David William Ewald, Wonder Lake, IL (US)

( * ) Notice: Subject to any disclaimer, the term of this patent is extended or adjusted under 35 U.S.C. 154(b) by 172 days.

(21) Appl. No.: 13/751,065

(22) Filed: Jan. 26, 2013

(65) Prior Publication Data

US 2014/0210238 A1 Jul. 31, 2014

(51) Int. Cl.
*A47C 3/029* (2006.01)
*A47C 17/64* (2006.01)
*A47C 1/14* (2006.01)

(52) U.S. Cl.
CPC ..... *A47C 3/029* (2013.01); *A47C 1/146* (2013.01); *A47C 17/64* (2013.01)

(58) Field of Classification Search
CPC ..... A47C 3/029
USPC ..... 297/452.14, 270.1, 270.4, 270.5, 397, 297/400, 188.2; 482/146
See application file for complete search history.

(56) References Cited

U.S. PATENT DOCUMENTS

| | | | | | |
|---|---|---|---|---|---|
| 167,514 | A | | 8/1952 | Hicks | |
| D167,514 | S | | 8/1952 | Hicks | |
| 3,072,435 | A | * | 1/1963 | Komulainen | 297/271.6 |
| 3,526,429 | A | * | 9/1970 | Metzger | 297/271.5 |
| 3,659,865 | A | * | 5/1972 | Nothacker | 280/7.1 |
| 4,141,588 | A | * | 2/1979 | Anderson | 297/271.5 |
| 4,241,949 | A | * | 12/1980 | Parker | 297/3 |
| 4,498,704 | A | * | 2/1985 | Hildreth | 297/397 |
| D307,221 | S | * | 4/1990 | Mudge | D6/502 |
| 4,919,481 | A | * | 4/1990 | Garabedian | 297/271.6 |
| D314,284 | S | * | 2/1991 | Cohen | D6/348 |
| 5,076,646 | A | * | 12/1991 | Matte | 297/452.14 |
| 5,213,394 | A | | 5/1993 | Tatttrie | |
| D337,445 | S | | 7/1993 | Sando | |
| 5,382,072 | A | * | 1/1995 | Diefenbach | 297/1 |
| 5,822,906 | A | | 10/1998 | Ward | |

(Continued)

FOREIGN PATENT DOCUMENTS

KR 101155211 * 6/2012

OTHER PUBLICATIONS

Cabela's Waterfowl catalog, search results for "layout blind", http://www.cabelas.com/catalog/search.cmd?form_state=searchForm&N=0&fsch=true&Ntk=AllProducts&Ntt=layout+blind&x.

(Continued)

*Primary Examiner* — David R Dunn
*Assistant Examiner* — Timothy J Brindley
(74) *Attorney, Agent, or Firm* — Eric L. Lane; Green Patent Law

(57) ABSTRACT

A hunting blind comprising a metal framework that is bent at the midpoint of the long axis at an angle in the range of one hundred to one hundred sixty degrees to form a leg rest portion, a seatback portion, a first curved rocker, and a second curved rocker. The leg rest portion comprises a seat. The seatback portion comprises a first stop leg, second stop leg and back support. Diagonal side supports connect the leg rest portion to the seatback portion. A hunting blind comprising a molded polymer unit with a leg rest portion, seatback portion, molded swivel rocker, molded seat indentation, and first and second rotatable stop legs. A hunting blind comprising a molded polymer leg rest component, molded polymer seatback component, first and second connecting rods, and first and second rotatable stop legs.

15 Claims, 11 Drawing Sheets

(56) References Cited

U.S. PATENT DOCUMENTS

| | | | | |
|---|---|---|---|---|
| 5,887,944 | A * | 3/1999 | Boost | 297/258.1 |
| 5,921,627 | A | 7/1999 | Risetter | |
| 5,988,465 | A * | 11/1999 | Vitale et al. | 224/155 |
| 6,250,712 | B1 | 6/2001 | Livington et al. | |
| 6,415,807 | B1 | 7/2002 | Maher | |
| 6,698,131 | B2 | 3/2004 | Latschaw | |
| 6,820,928 | B1 | 11/2004 | Ransom | |
| D521,752 | S * | 5/2006 | Messier | D6/348 |
| 7,213,277 | B1 * | 5/2007 | Hsieh | 5/101 |
| D548,986 | S * | 8/2007 | McCoy et al. | D6/344 |
| D548,987 | S * | 8/2007 | McNae | D6/344 |
| 7,374,517 | B2 * | 5/2008 | Lockett | 482/131 |
| 7,422,278 | B2 * | 9/2008 | McConnell et al. | 297/182 |
| D588,368 | S * | 3/2009 | McCoy et al. | D6/344 |
| D594,239 | S * | 6/2009 | Lake et al. | D6/348 |
| 7,575,241 | B1 | 8/2009 | Keller | |
| 7,632,218 | B2 * | 12/2009 | Sannes et al. | 482/51 |
| D615,310 | S * | 5/2010 | Cybulski | D6/348 |
| 7,717,514 | B2 | 5/2010 | Redmann | |
| 7,798,569 | B2 * | 9/2010 | Comarella | 297/188.2 |
| 7,951,056 | B2 * | 5/2011 | Radzwill | 482/142 |
| 7,997,291 | B2 | 8/2011 | Gressette et al. | |
| D649,370 | S * | 11/2011 | Mann | D6/348 |
| 8,056,982 | B2 | 11/2011 | Loney | |
| 8,246,341 | B2 * | 8/2012 | Hanson | 425/453 |
| D677,915 | S * | 3/2013 | Chadwick | D6/348 |
| 2002/0152559 | A1 * | 10/2002 | Muirhead | 8/405 |
| 2004/0000084 | A1 | 1/2004 | Latschaw | |
| 2006/0097555 | A1 * | 5/2006 | Meleger | 297/271.6 |
| 2009/0015040 | A1 | 1/2009 | Redmann | |
| 2009/0243345 | A1 | 10/2009 | Carter et al. | |
| 2010/0019550 | A1 | 1/2010 | Cook et al. | |
| 2010/0078979 | A1 * | 4/2010 | Nemoto | 297/250.1 |
| 2010/0171341 | A1 | 7/2010 | Loney | |
| 2010/0176639 | A1 | 7/2010 | Balgaard | |
| 2012/0038189 | A1 * | 2/2012 | McConnell et al. | 297/182 |
| 2012/0181840 | A1 * | 7/2012 | Leone et al. | 297/452.3 |
| 2012/0274105 | A1 * | 11/2012 | Chen et al. | 297/183.1 |
| 2013/0043707 | A1 * | 2/2013 | Yoon | 297/284.4 |
| 2014/0077573 | A1 * | 3/2014 | Schneider et al. | 297/452.14 |

OTHER PUBLICATIONS

Wildfowler Outfitter Goose Decoy Blind Skirt, http://www.wildfowleroutfitter.com/index.php/goose-decoy-blind-skirt.html.

Philip Bourjaily, Field & Stream Magazine Promotional Article, Feb. 2013 issue.

* cited by examiner

ROCKER-EQUIPPED HUNTING BLIND

BACKGROUND OF THE INVENTION

1. Field of the Invention

The present invention is related to the field of camouflaged hunting blinds, and more particularly, to a layout-type blind in which a hunter hides in a reclining position, and rises to a sitting position for shooting.

2. Description of the Related Art

There are numerous examples of hunting blinds with integral seats and camouflage covers that are the subject of issued patents or published applications, hut none of these inventions includes the structural features and functional advantages of the present invention, most notably:

- A frame structure that allows a hunter to comfortably lie motionless for an extended period of time in a stable low-profile reclining position with the feet lower than the head.
- A rocker system that allows the hunter to rock up into a sitting position for shooting with less effort and less time than required for prior-art blinds.
- A frame that requires no moving parts to assist the hunter in rising from a reclining to a sitting position.
- A frame having stop legs that contact the ground surface when the blind is in the fully reclined position. These stop legs prevent the blind from rocking back too far and keep the blind and hunter in a stable, stationary position when fully reclined.
- A frame that keeps the hunter above the ground surface for warmth and comfort.
- A frame that is lightweight and may be economically shaped to be carried on the back (like a backpack) into and out of the field. Hunting supplies, harvested game, etc. may be easily strapped to the blind for transport when she third is in the backpack position.
- A frame that may be shaped so as to function as a sled to haul hunting equipment and the blind itself to and from the hunting site.
- A frame that may comprise optional removable wheels so as to function as a cart to haul hunting equipment and the blind itself to and from the hunting site, and in which the wheels may be removed for hunting in order to keep the hunter's profile as low to the ground as possible.
- A shroud component that disguises the shape and contours of the blind and hunter for better camouflage. The free-form shape of the shroud eliminates right angles and the boxlike-shapes common in prior-art blinds, thereby making the present invention less noticeable to birds. The color and pattern of the shroud may be selected to provide optimal camouflage for a particular terrain type (for example, harvested corn field, beet field, bare dirt, snow, river cobble).
- A frame and shroud that are designed for rapid setup and takedown in the field, as compared to other layout blinds.
- A frame and shroud that are made of materials that allow the blind to be inexpensively manufactured as compared to other layout blinds.
- A frame that allows for easy ingress and egress for less mobile hunters.
- An optional conical-shaped base that assists in horizontally swiveling the blind and a low-friction seat that assists in horizontally swiveling the hunter so that the hunter can achieve a better shooting position for targets to either side of the blind.

- Optional compartments that may be installed near the foot end of the structure for storage of field supplies such as ammunition, thermos bottle, lunch etc. Placing materials into the compartments will cause the center of gravity of the blind to move toward the feet of the hunter, thereby requiring less effort for the hunter to rise from the reclining to the shooting position.
- An optional telescoping seatback support, leg rest support, and/or headrest that allow the blind to be adjusted to fit burners of different heights.
- Optional length adjusters on the recliner stop legs that provide the best combination of comfort, ability to rise, and disguise, for hunters of different weights and preferences.

Examples of prior art inventions are discussed below:

A low-profile sportsman's seat with a relocatable backrest is disclosed in U.S. Pat. No. 6,820,928 (Ransom, 2004). The apparatus folds up for carry on a strap. The apparatus does not comprise any features that allow a user to rock from a reclining to a sitting position.

A portable hunting chair with fabric camouflage sides and roof is disclosed in U.S. Pat. No. 7,997,291 (Gressette et al., 2011). The apparatus folds up and has shoulder straps for carrying. It does not comprise any features that allow a user to rock from a reclining to a sitting position.

A portable pit blind is disclosed in U.S. Pat. No. 5,822,906 (Ward, 1998). This apparatus is a shell with a cover that is designed to be buried in the ground, with the top of the cover approximately at ground level, in order to hide a hunter positioned within the shell. There is no provision for the apparatus to rock or otherwise move in relation to the ground that would aid the hunter in rising from a reclining to a sitting position.

A power-assisted hunting prop that launches a hunter from a reclining to a shooting position is disclosed in U.S. Pat. No. 5,921,627 (Risetter, 1999). The apparatus is powered by twin coil springs that are compressed by the hunter when the backrest of the apparatus is pushed downward to a reclining position. When the reclining hunter pulls a trigger cord, the spring tension is released, thereby pushing the backrest upward to an angled position, which raises the hunter to a partially inclined shooting position. Unlike the present invention, this invention comprises multiple mechanical parts that move in relation to each other each time the apparatus is cocked and released, in a manner somewhat similar to a large mouse trap. The springs and other moving parts of this invention provide inherent safety risks for the user (such as pinched hands, accidental releases, etc.). These risks are eliminated by the present invention because it contains no moving parts. In addition, the mechanical components of this apparatus are inherently more prone to failure under field conditions than the simple but effective rocker mechanism of the present invention.

A foldable chair that is suitable for use in hunting is disclosed in U.S. Pat. No. 6,250,712 (Livingston et al., 2001). This apparatus does not have any features that assist the user in rising from a reclining to a sitting position.

A collapsible hunting blind is disclosed in U.S. Pat. No. 6,698,131B2 (Latschaw, 2004). This apparatus is an example of a conventional folding layout blind that comprises a collapsible frame and a camouflage cover. This apparatus does not have any features that assist the user in rising from a reclining to a sitting position or for enabling the user to swivel from side to side. The "rotatable" connections that are described in this patent are hinged connections that allow the frame to be folded for compact transport and storage.

U.S. Pat. No. 7,575,241 (Keller, 2009) discloses an apparatus designed to assist a hunter in rising from a supine (reclining) to a sitting position by means of a hinged backrest. In use, the backrest is raised from the horizontal to the vertical position by the hunter shifting his body position downward, so that less weight is applied to the top of the backrest, causing the backrest to pivot like a seesaw. The raising of the backrest may be assisted by biasing springs that are optionally adjustable for individual users. The apparatus comprises wheels to aid in transport to and from the hunting location. The hinges and optional spring components of this invention are eliminated by the rocker design of the present invention.

A hunting swivel chair is disclosed in U.S. Patent Application 2009/0243345A1 (Carter et al., 2009). The apparatus has adjustable-height lags and a swivel base, but it does not provide for a reclining position.

U.S. Pat. No. 7,717,514 (Redmann, 2010) discloses an adjustable chair that is particularly suited for hunting. The apparatus comprises a seatback and a seat platform that are adjustable prior to use (for example, they may be set to upright or to reclined) but that are not designed to aid the hunter in rising from a reclined to an upright position during use. The apparatus incorporates a swivel seat feature to allow the user to rotate from side to side.

U.S. Pat. No. 8,056,982 (Loney, 2011) discloses a compact, collapsible chair (similar in shape to a chaise lounge without legs) comprising a frame that may be folded into a very compact size for backpacking, etc. This apparatus does not have any features that assist the user in rising from a reclining to a sitting position.

U.S. Pat. No. 6,413,807 (Maher, 2002) discloses a hunting blind/decoy comprised of a swivel seat and an oversized bird decoy that fits over the seat and hunter. This apparatus does not comprise any features to assist the user in rising from a reclining to a sitting position.

U.S. Patent Application Pub. No. 2010/0019550 (Cook et. al., 2010) discloses an adjustable hunter seat in which the backrest tilt angle and the seat tilt angle can be independently set prior to use but remain fixed during use. The apparatus is capable of swiveling horizontally and may be folded for compact carry and storage. This apparatus does not comprise any features to assist the user in rising from a reclining to a sitting position.

U.S. Patent Application Pub. No. 2010/0176639 (Balgaard, 2010) discloses an assisted-lift reclining chair that is designed to be used in conjunction with a conventional lay-down blind. The chair aids a hunter in rising from a reclining to a sitting position by use of a torsion spring attached to a pivoting backrest. The spring force is designed so that the weight of the hunter compresses the spring, thereby forcing the backrest into a reclining position. The spring mechanism of this apparatus is somewhat similar to that described in U.S. Pat. No. 5,921,627 (a mousetrap-type spring operation), and the same disadvantages apply to this design as to the '627 patent.

U.S. Pat. No. D167,514 (Guild, 1952) discloses an ornamental design for a contour chair that can be folded, for use as au ottoman. The shape of this chair cannot provide for rocking motion.

U.S. Pat. No. D377,445 (Sando, 1993) discloses an ornamental design for a foldable beach chair. The chair appears to have a rounded bottom that might provide some rocking ability, but it does not appear to compose any stops that would provide for a stable reclining position.

A molded recliner rocker chair is disclosed in U.S. Pat. No. 5,213,354 (Tattrie, 1993). The apparatus has curved side rails of varying thickness to provide increased strength at the point of maximum loading. The apparatus, which is not designed for hunting applications, does not have stops to prevent over-rotation. In the reclining position, nor does it incorporate any type of fabric camouflage covering, nor is it designed to be comfortable and stable for an extended period of time when used in the reclining position.

For example, referring to FIG. 6 of the Tattrie patent, the invention is shown in the reclining position, with the user's feet elevated higher than his head. No means are shown for stabilizing the invention from rocking up and down as the user makes slight body shifts. In contrast, in the present invention, as shown in FIG. 2, the user's feet are positioned below the elevation of his head while he is in the reclining position, and the stop legs of the present invention prevent the invention from rocking when the user makes body shifts. Comparison of a person in a reclining position in these two inventions clearly illustrates that the structure of the present invention will result in a person being more comfortable for extended periods of time when using the present invention than the Tattrie invention.

Additionally, unlike the present invention, the Tattrie invention does not have a smooth seat to enable the user to swivel his body from side to side on the seat, nor does it have an optional conical-shaped base that allows the device to swivel from side to side on the ground surface. The Tattrie design is not compatible with the optional length adjustment features of the leg rest, seatback and headrest of the present invention. The shape of the Tattrie invention is not compatible with being transported by sliding (as a sled) or carrying on the back (as a backpack) as is the present invention. Finally, the Tattrie invention does not have a feature for adjusting the center of balance, as is provided by the optional storage bags of the present invention.

In addition to issued and pending patents, there are numerous non-patented devices that are commercially available. A variety of layout-type blinds, for example, are advertised for sale by Cabela's Inc. of Sidney, Nebr., a large retailer of hunting equipment. The Cabela's 2012 Waterfowl catalog listed over twenty different variations of layout blinds. All of these blinds are generally of a rectangular box shape and made so that a hunter can hide within the blind in a slightly inclined, face-upward, prone position, with the legs and buttocks separated from the ground surface by a layer of cloth and an optional pad, and the torso elevated from the ground by an internal frame.

The inventors of the present invention are also aware of one commercial product that is advertised as a combination decoy and blind that does provide an assisted sit-up feature. This product, named the "Goose Recliner," is manufactured by Wildfowler Outfitter of Chaska, Minn. This device comprises on oversized goose decoy shell that is mounted over a reclining seat. The hunter sits in the seat in a reclining position with decoy shell positioned over his head and torso. To shoot, the decoy shell is popped away from the hunter via a spring-loaded swivel mechanism attached to the headrest portion of the seat. The hunter then rises to a sitting position via "a sling-style seat that propels you to a natural sitting position," according to the manufacturer.

The latter device is structurally different from the present invention in that the seat portion of the Goose Recliner comprises multiple steel rods on each side of the frame that are joined by a hinged connector, and the rods move back and forth in relation to each other as the seat is moved from a reclining to a sitting position, in a similar manner to the rods comprising the frame of a chaise-lounge lawn chair. In contrast, the parts of the present invention remain fixed in relation to the other parts as the device is "rocked" forward from a reclining to a sitting position. The present invention is, therefore, advantageous over the Goose Recliner because it eliminates the requirement for hinges and parts that move with respect to other parts of the device and is thereby more durable and less prone to failure.

In addition to commercial blinds, there are also commercially available camouflage covers that may be purchased separately from the blinds and that may be placed over the blinds to simulate, for example, green or brown vegetation or snow. Like the blinds, these commercial covers are all generally shaped as the term of a rectangular box, in order to fit over the blinds, in contrast to the shroud covering of the present invention, which is of a free-form shape.

BRIEF SUMMARY OF THE INVENTION

The present invention is a hunting blind comprising: a metal framework having a long axis with a midpoint, wherein the metal framework is bent at the midpoint of the long axis at an angle in the range of one hundred to one hundred sixty degrees to form a leg rest portion, a seatback portion, a first curved rocker, and a second curved rocker; wherein the leg rest portion comprises a seat; wherein the seatback portion comprises a first stop leg, a second stop leg and a back support; and wherein diagonal side supports connect the leg rest portion to the seatback portion. In one embodiment, the metal framework is rectangular in shape. In another embodiment, the metal framework is oval-shaped.

In a preferred embodiment, the leg rest portion, the seatback portion, and the first and second stop legs are adjustable in length. Preferably, the first and second stop legs are attached to the seatback with rotatable connectors that allow the stop legs to be folded parallel to the seatback. In a preferred embodiment, the invention further comprises shoulder straps that are attached to a back of the seatback portion. The seatback portion is preferably adjustable longitudinally.

In yet another preferred embodiment, the invention is a hunting blind comprising: a molded polymer unit comprising a leg rest portion, a seatback portion, a molded swivel rocker, a molded seat indentation, a first rotatable stop leg, and a second rotatable stop leg; wherein the leg rest portion, the seatback portion, the swivel rocker and the seat indentation are manufactured as a single continuous component; and wherein the swivel rocker is bowl-shaped. Preferably, the first and second stop legs are configured to rotate ninety degrees. The invention preferably further comprises an adjustable headrest.

In a preferred embodiment, an outer perimeter of the hunting blind is anatomically shaped to fit a hunter. In another preferred embodiment, the invention further comprises a lip that extends upward from and around a perimeter of the hunting blind. In one embodiment, the invention further comprises molded-in sled runners that extend longitudinally along a portion of an underside surface of the leg rest portion. In an alternate embodiment, the invention further comprises molded-in sled runners that extend longitudinally along a portion of an underside surface of the seatback portion.

In yet another preferred embodiment, the invention is a hunting blind comprising: a molded polymer leg rest component, a molded polymer seatback component, a first connecting rod, a second connecting rod, a first reusable stop leg, and a second rotatable stop leg; wherein the molded polymer leg rest component comprises a molded seat indentation; and wherein the first and second connecting rods fit into inserts that are molded into the leg rest component and the seatback component. Preferably, the invention further comprises an adjustable headrest.

In a preferred embodiment, the invention further comprises a first side support and a second side support, wherein the first and second side supports fit into inserts that are molded into the leg rest component and the seatback component. Preferably, the leg rest component further comprises a rocker portion. Preferably, the leg rest component further comprises a bowl-shaped swivel rocker.

In a preferred embodiment, the leg rest component and the seatback component are comprised of injection-molded thermoplastic. In an alternate embodiment, the leg rest component and the seatback component are comprised of thermoset polymer. In another alternate embodiment, the leg rest component and the seatback component are comprised of rotation-molded thermoplastic that is filled with thermoset polymer foam. In another alternate embodiment, the leg rest component and the seatback component are comprised of blow-molded thermoplastic that is filled with thermoset polymer foam.

In a preferred embodiment, the invention further comprises molded-in sled runners that extend longitudinally along a portion of an underside surface of the leg rest component. In an alternate embodiment, the invention further comprises molded-in sled runners that extend longitudinally along a portion of an underside surface of the seatback component.

In a preferred embodiment, the invention further comprises a shroud that covers the hunting blind, wherein the shroud is of a freeform shape, wherein an outer surface of the shroud is comprised of camouflage fabric, and wherein the shroud comprises a face hole, a right gun slot, and a left gun slot. The invention preferably further comprises a storage bag that is attached with straps to a terminal end of the leg rest portion. The first and second stop legs are preferably adjustable in height.

In a preferred embodiment, the invention further comprises a first removable wheel assembly and a second removable wheel assembly; wherein the first removable wheel assembly is attached to a first side of the hunting blind, and the second removable wheel assembly is attached to a second side of the hunting blind; wherein the hunting blind has a center of balance; and wherein the first and second wheel assemblies are attached proximate to the center of balance. Preferably, the swivel rocker is comprised of a polymer material having a coefficient of friction of about 0.3 or less against packed sand, a Shore D hardness of at least D69, and a tensile strength of at least 4600 pounds per square inch.

REFERENCE NUMBERS

Figure 1:
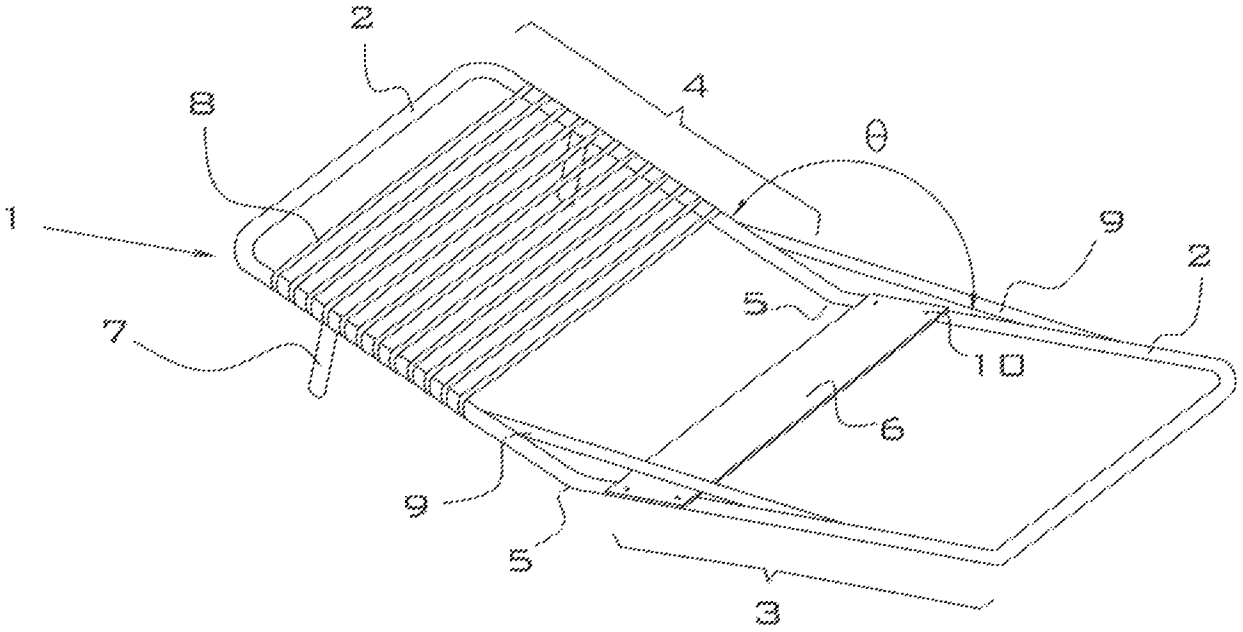
FIG. 1 is a perspective view of the first embodiment of the present invention, shown with the camouflage shroud removed for clarity.

1 Rocker blind, first embodiment
2 Framework
3 Leg rest portion
4 Seatback portion
5 Rocker
6 Seat
7 Fixed stop leg
8 Back support webbing
9 Side support
10 Seat attachment bolt
11 Hunter
12 Ground surface
13 Shroud
14 Face hole
15 Gun slot
16 Gun
17 Camouflage surface
18 Rocker blind, second embodiment
19 Molded seat indentation
20 Rotatable stop leg
21 Swivel rocker
22 Adjustable headrest
23 Storage bag
24 Perimeter lip
25 Hand hole
26 Bolt
27 Hole in stop leg
28 Rocker blind, third embodiment
29 Molded leg rest component
30 Molded seatback component
31 Connecting rods
32 Wheel assembly
33 Tire
34 Rim
35 Axle
36 Cotter pin
37 Dog
38 Tow rope
39 Shoulder strap
40 Equipment bag
41 Sled runner

DETAILED DESCRIPTION OF INVENTION

The present invention is an improved-design layout blind for hunting in fields, and particularly, for use in hunting geese and ducks that are feeding in agricultural fields, such as harvested corn, wheat or beet fields. These types of agricultural fields typically contain plant stem residue and/or dirt clods that usually range in height from approximately one to twelve inches. The purpose of a layout blind is to provide a low-profile, camouflaged hiding space for the hunter, in which the blind resembles the surrounding terrain and thereby prevents the birds from detecting the presence of the hunter, even when the blind is located in relatively flat terrain with no brush, ditches, or other means of providing concealment for the hunter.

The hunted birds are typically attracted to the vicinity of the concealed hunter via the use of audible calling devices (i.e., duck and goose calls) and decoys. When the birds are attracted within effective range of the hunter's shotgun, the hunter quickly rises and fires at the birds, while the birds commonly flare away at the first movement that the hunter makes when rising to shoot. Since the birds have the ability to fly rapidly out of range when flaring, it is important for the hunter to be able to rise quickly from a low-profile hiding position to a sitting-up shooting position and to fire as quickly as possible after rising when the opportunity for a shot occurs. The present invention is designed to minimize the time and effort required for a hunter to rise and fire at birds that come within range.

In the prior art, the effort required to rise from a low-profile (i.e., reclined) position to a shooting (i.e., sitting) position is significant and resembles the effort required to do a standard sit-up exercise. By contrast, the present invention comprises rockers that provide a function similar to the rockers on a rocking chair, so that the initial momentum of the rising shooter assists in bringing the shooter to a sitting position in one easy fluid motion, with leas effort than required for a standard layout blind. The effort and motion required to rise from a reclined to a sitting position in the present invention is approximately the same as required to do a Pilate crunch exercise. In typical use, the hunter places his legs, with knees bent, on each side of the blind while reclining; then to rise, the hunter straightens his knees and brings his legs together while also pushing his shotgun forward. These movements shift the center of gravity of the hunter/blind combination forward and cause the rockers of the blind to rock forward, bringing the hunter to an upright sitting position with little or no assistance required from the hunter's abdominal muscles.

With prior art devices, a hunter is not easily able to turn to the left or right when in the shooting position because of friction between the hunter's pants and the seat portion of the blind. The hunter is able to easily rotate the seat of his pants on the seat of the present invention, however, because the seat portion is manufactured so as to be particularly smooth and, therefore, to have a low coefficient of friction. As a result of this feature, the hunter is able to fire more accurate shots at birds that fly to the left or right sides of him.

Finally, in conventional layout blinds, the enclosed sides and partially enclosed tops of these blinds make entry and exit slow and difficult, particularly for hunters with limited mobility. By contrast, the present invention (with the shroud removed) has relatively low sides and a fully open top, making entry and exit much easier. In sum, the present invention assists the hunter by providing quick and easy rise and rotation for shooting, along with easy entry and exit.

The present invention comprises a frame component and a shroud cover component. The frame comprises a lower portion and an upper portion. The lower portion corresponds to the seat of a conventional chair but is somewhat longer and supports the buttocks and legs of the hunter; the lower portion is the frame is referred to herein as the "leg rest" portion of the device. The upper portion corresponds to the seatback or backrest of a conventional chair, is of sufficient length to support the back and the head of the shooter, and is referred to herein as the "seatback" portion of the device. Unlike a conventional chair, in which the angle of the seatback to the seat is approximately ninety (90) degrees, the seatback and leg rest of the present invention are set at a more open angle (for example, in the range of one hundred (100) to one hundred sixty (160) degrees, with one hundred thirty-five (135) degrees being typical) so that, when the device is in the fully upright position with the leg rest parallel to the ground surface, the seatback is tilted rearward, typically at an angle of about forty-five (45) degrees with the ground surface.

The frame of the present invention is rounded on the lower side at the location where the setback and leg rest portions of the device meet, and this rounded area forms a rocking surface for the device against the ground. The radium of curvature for the rounded portion of the device is preferably in the range of six (6) to twelve (12) inches.

When a hunter is sitting in the present invention in a reclining position, the leg rest and the seatback are inclined at approximately equal angles to the ground surface; in other words, from a side view, the upper and lower portions of the present invention form a "V" shape with respect to the ground surface, with the rounded portion (i.e., the rocker) resting on the ground surface. The seatback portion of the present invention comprises two short "stop legs" that protrude generally perpendicularly out from the rear of the seatback. These stop legs contact the ground surface when the device is in the fully reclined position and serve as stops to prevent the seatback from tilting back more than desired when the device is reclined. These stop legs may optionally be attached to the seatback with rotatable connectors that allow the stop legs to be folded parallel to the seatback. When the stop legs are folded, the back side of the seatback is relatively flat and smooth, enabling the present invention to be slid across the ground like a sled by pulling a rope attached to the seatback portion of the present invention. Alternately, shoulder straps may optionally be attached to the back of the seatback portion of the present invention, thereby allowing it to be carried like a backpack to and from the field.

The seatback and leg rest portions of the present invention are approximately two feet in length each. In one embodiment of the present invention, the seatback and leg rest may optionally be made so as to be adjustable in length, for example, by use of telescoping metal tubing. In all of the embodiments of the present invention, the stop legs may optionally be made adjustable for length.

The shroud component of the present invention covers the frame and the hunter for the purpose of providing camouflage. The shroud comprises a face hole and gun slots so that the hunter can see and shoot while remaining beneath the shroud. The gun slots may be a simple opening through which the gun is pushed in order to free it for shooting, or alternately, the gun slots may comprise an extra layer of material (either on top of or on the underside of the shroud) sewn or otherwise attached to the shroud to form a pocket for placing the gun when the hunter is waiting for game. Some hunters may desire to use the present invention without the shroud cover by utilizing appropriate camouflage clothing instead of the shroud. The shroud may optionally be made oversize in order to provide space for a hunting dog to hide alongside the hunter under the shroud.

The present invention encompasses three embodiments. In the first embodiment, the present invention comprises a tubular metal framework. In this embodiment the backrest support and seat may be comprised of woven fabric webbing, boards, or other suitable material. The seat may optionally be adjustable longitudinally, by sliding the seat forward or rearward along the tubular frame that supports the seat, to vary the center of gravity of the device.

The second embodiment of the present invention comprises a one-piece molded polymer frame that incorporates the seat, seatback and leg rest into a single component that may be manufactured by injection molding, rotational molding, blow molding, or other suitable method of molding.

The third embodiment of the present invention comprises a molded polymer leg rest component, a separate molded polymer seatback component, and tabular metal framing that connects the two polymer components.

Any of the three embodiments of the present invention may be equipped with a pair of optional removable wheels. These wheels are used to help transport the blind to and from the hunting location, and they allow the blind to be easily pushed or pulled across rough ground, even when packed with heavy hunting equipment such as a gun, ammunition, and decoys. When the blind is deployed for hunting, the wheels may be temporarily removed, thereby keeping the profile of the blind and hunter as low to the ground surface as possible. The second and third embodiments may include optional molded-in sled runners.

Any of the three embodiments may be modified for use with a hunting dog in combination with the hunter, wherein the dog lies between the legs of the hunter when the hunter is in the reclining position and then springs forward (in the direction of the hunters feet) upon command when the hunter desires to rise to the sitting position. The forward movement of the dog shifts the center of gravity of the invention toward the feet of the hunter, thereby providing additional assistance to enable the hunter to rise easily and quickly with minimal physical effort. When a dog is employed in this manner, the camouflage shroud is modified so as to comprise a slit opening for the dog's ingress and egress, and the leg rest portion of the invention is sized so as to have adequate length to support the dog's body.

FIG. 1 is a perspective view of the first embodiment 1 of the present invention, shown with the camouflage shroud removed for clarity. The first embodiment 1 comprises a generally rectangular metal framework 2 that is bent at the approximate midpoint of its long axis at an angle θ (typically set to about one hundred thirty-five (135) degrees) so as to form a leg rest portion 3, a seatback portion 4, and two curved rockers 5. The leg rest portion 3 comprises a seat 6. The seatback portion 4 comprises two stop legs 7 and a back support webbing 8. Diagonal side supports 9 connect the leg rest portion 3 to the seatback portion 4 and provide additional strength and rigidity to the structure; they may also be used for support by a hunter entering or departing from the present invention.

The framework 2, stop legs 7 and side supports 9 are preferably comprised of metal tubing. The metal tubing is preferably aluminum tubing having an outside diameter of approximately one (1) inch or, alternately, powder-coated steel tubing having an outside diameter of about three-quarters (¾) inch. Although the framework 2 is shown as being generally rectangular in shape, it may be configured in a variety of shapes that will comfortably accommodate a hunter. For example, the metal tubing may be bent so that the framework 2 is narrower at the head and foot portions than in the center, thereby being generally oval-shaped when viewed from above. The seat 6 is preferably attached to the framework 2 by through-bolts 10. The side supports 9 are preferably attached to the framework 2 by welding. The leg rest portion 3, seatback portion 4, and stop legs 7 may optionally be made adjustable in length by the use of telescoping tubing members (not shown).

Figure 2:
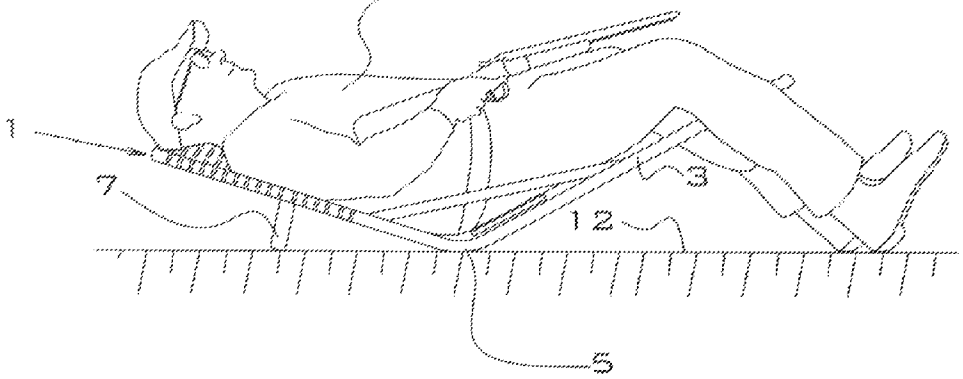
FIG. 2 is a side view of a hunter lying in a reclining position in the first embodiment of the present invention with the shroud omitted for clarity.
Figure 3:
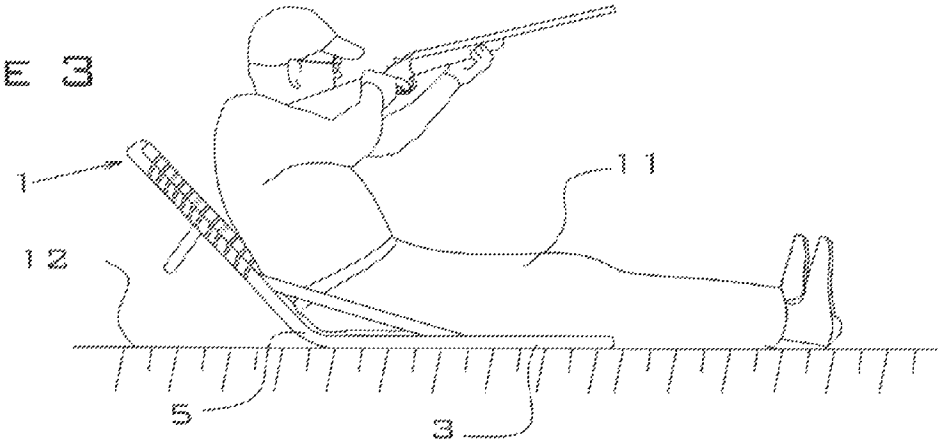
FIG. 3 is a side view of a hunter sitting in the upright position of the first embodiment of the present invention with the shroud omitted for clarity.

FIG. 2 is a side view of a hunter 11 lying in a reclining position on the first embodiment 1 of the present invention, with the shroud omitted for clarity. FIG. 3 is a side view of a hunter 11 sitting in the upright position of the first embodiment 1 of the present invention, with the shroud omitted for clarity. Referring to FIG. 2, when the first embodiment 1 of the present invention is positioned in the reclining position, the only components that make contact with the ground surface 12 are the rockers 5 and the stop legs 7. The legs of the hunter 11 are bent at the knee, and one leg extends to the outside of each side of the leg rest portion 3, so that the heels of the hunter's boots are lightly in contact with the ground surface 12 for comfort.

Referring to FIG. 3, when the first embodiment 1 of the present invention is in the upright position, the only component that makes contact with the ground surface is the leg rest portion 3. When the hunter is in the upright sitting position as shown in FIG. 3, his legs are extended and protrude beyond the end of the leg rest portion 3.

Figure 4:
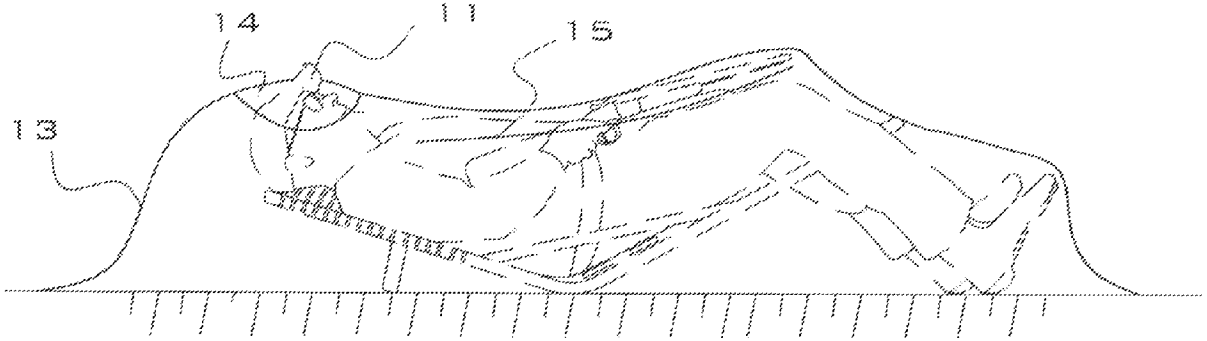
FIG. 4 is a side view of a hunter shown in a reclining position in the first embodiment of the present invention with the camouflage shroud shown in cross section.
Figure 5:
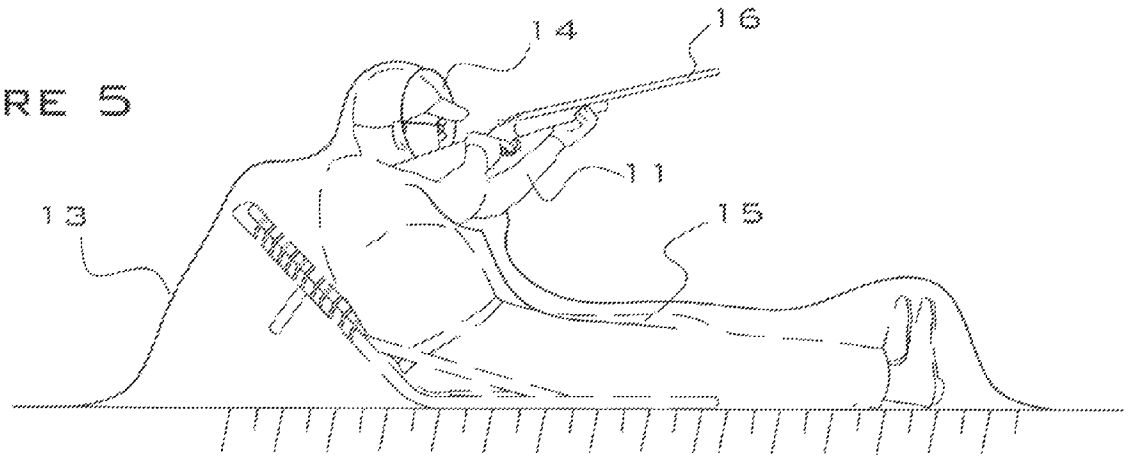
FIG. 5 is a side view of a hunter shown in an upright position in the first embodiment of the present invention with the camouflage shroud shown in cross section.

FIGS. 4 and 5 are side views of a hunter 11 shown in a reclining and in an upright position, respectively, with the camouflage shroud 13 shown in cross section. These two figures illustrate the shape the shroud 13 when the present invention is deployed in the reclining position (FIG. 4) and in the upright position (FIG. 5). The shroud 13 comprises a face hole 14 and gun slots 15. The face hole 14 allows the hunter 11 to see while the majority of his body and head are hidden from view underneath the shroud 13. The gun slot 15 allows the gun 16 to remain camouflaged underneath the shroud 13 while the hunter 11 is waiting for birds to come into range, and then allows the gun 16 to be quickly passed through to a shooting position when the hunter 11 desires to fire a shot.

Figure 6:
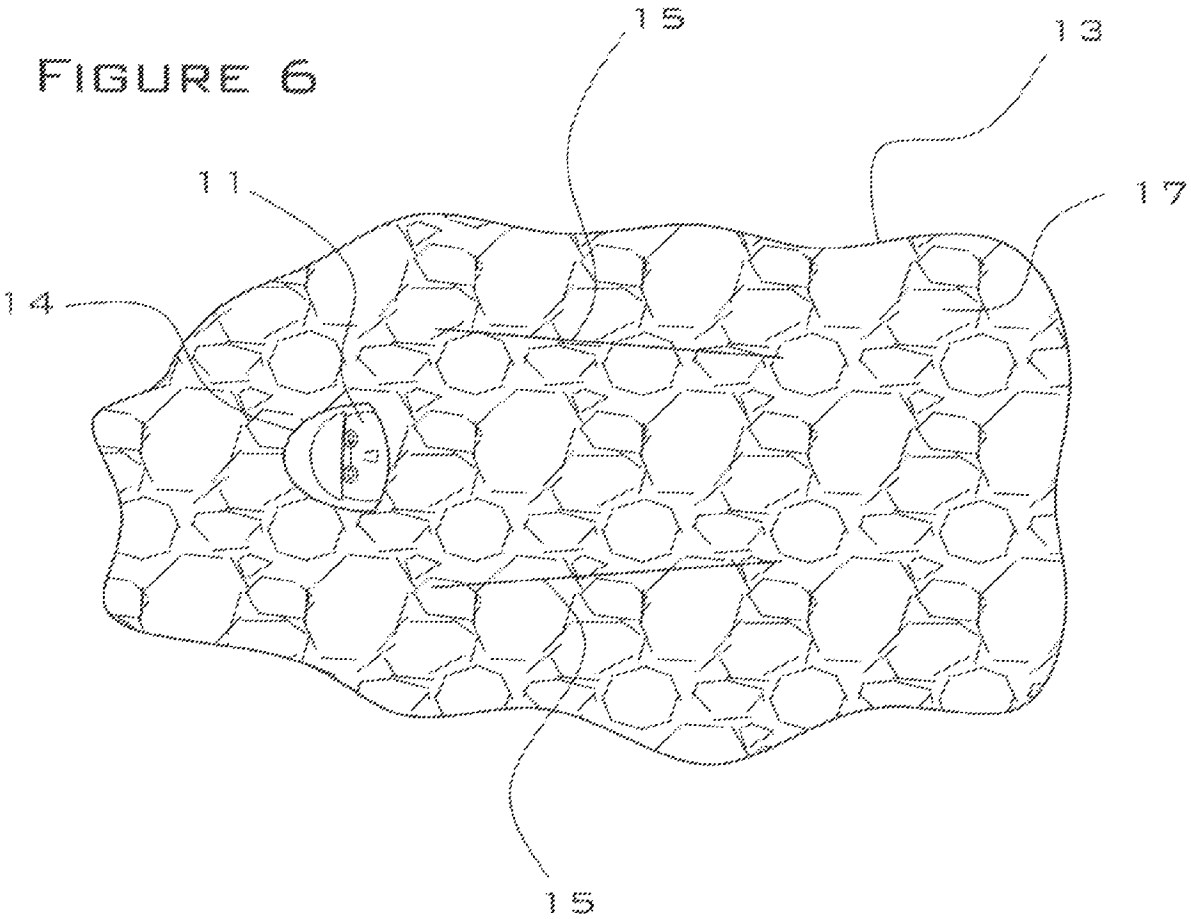
FIG. 6 is an overhead view of a hunter in any embodiment of the present invention, with the shroud in place.

FIG. 6 is an overhead view of a hunter 11 in any embodiment of the present invention, with the shroud 13 in place. The outer surface of the shroud 13 is preferably comprised of a camouflage fabric (woven or now-woven) with color and texture selected to blend in with the color and texture of the surrounding terrain. The perimeter of the shroud 13 is preferably made in a free-form shape as shown, rather than a rectangular shape, thereby providing a more natural appearance. The shroud 13 preferably comprises two guns slots 15 that are symmetrically located on either side of the shroud 13, thereby allowing the gun to be fired from either the left or right shoulder of the hunter 11.

Figure 7:
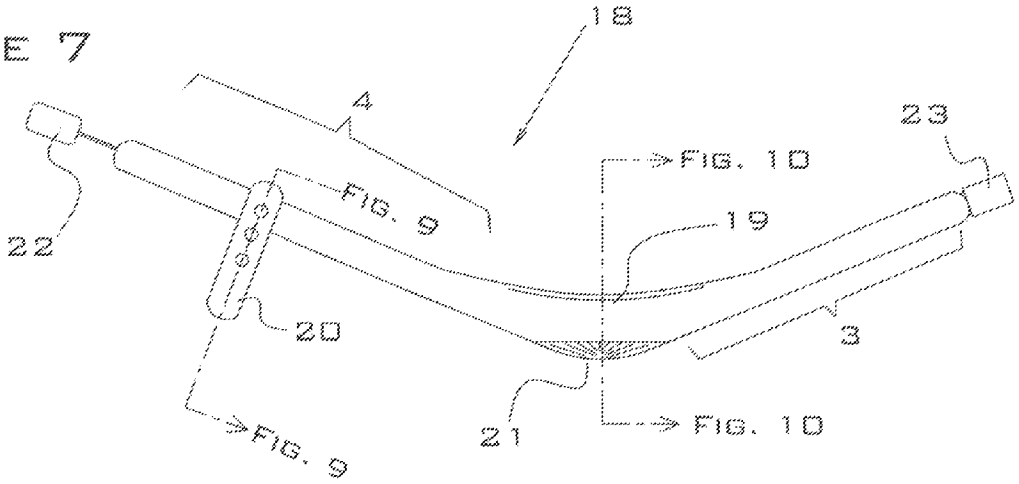
FIG. 7 is a side view of the second embodiment of the present invention, shown with the camouflage shroud removed for clarity.

FIG. 7 is a side view of the second embodiment 18 of the present invention with the shroud omitted for clarity. The second embodiment 18 is a molded polymer unit comprising a leg rest portion 3, a seatback portion 4, a molded swivel rocker 21, a molded seat indentation 19, and two attached rotatable stop legs 20. Also shown are an optional adjustable headrest 22 and an optional storage bag 23. The leg rest portion 3, seatback portion 4, swivel rocker 21 and seat indentation 19 are manufactured as a single continuous component. The swivel rocker 21 is bowl-shaped and allows the invention 18 to rock backward and forward; it also allows the invention 18 to rotate horizontally (i.e., to swivel from left to right around a vertical axis within a bowl-shaped depression that forms around the swivel rocker 21 when the swivel rocker 21 is pressed into the ground by a hunter sitting or reclining in the second embodiment 18). This swiveling capability allows a hunter to rise and then to rotate his body to the left or right in order to be better positioned to shoot at birds that are flying off to either side of the blind.

Figure 9:
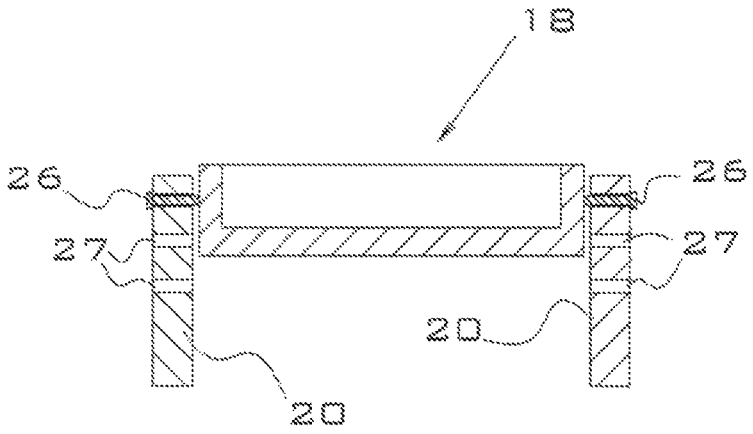
FIG. 9 is a cross-section view of the second embodiment of the present invention at the section indicated in FIG. 7, showing the rotatable stop legs.
Figure 10:
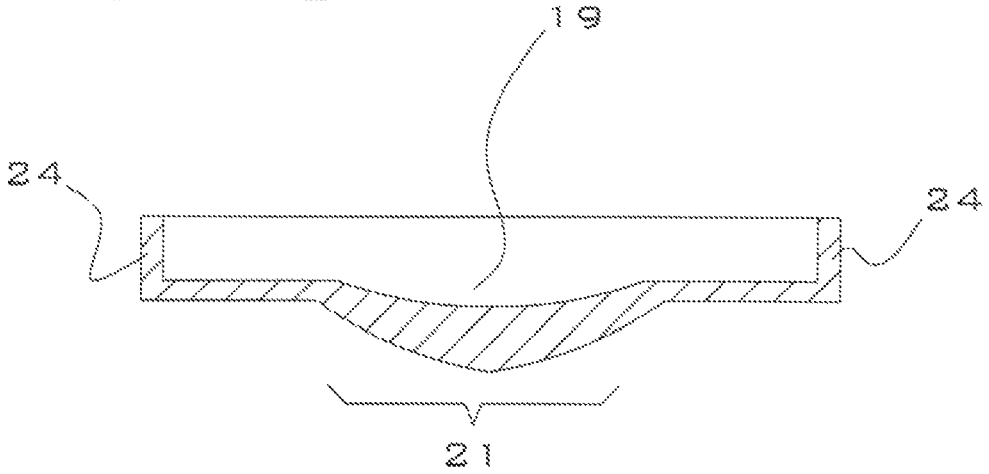
FIG. 10 is a cross-section view of the second embodiment of the present invention at the section indicated in FIG. 7, showing the molded seat indentation.

Cross-section views of the rotatable stop legs 20 and the swivel rocker 21 are shown in FIGS. 9 and 10. In order to swivel easily and to withstand the abrasion produced by the ground surface during use, the swivel rocker 21 is preferably made from a polymer material having a low coefficient of friction (for example, a coefficient of about 0.3 or less for the material against packed sand), a high degree of hardness (for example, a Shore D hardness of about D69 or greater), and a high tensile strength (for example, an alienate yield strength of 4600 pounds per square inch or greater). These same characteristics apply equally to the swivel maker of the third embodiment.

Figure 8:
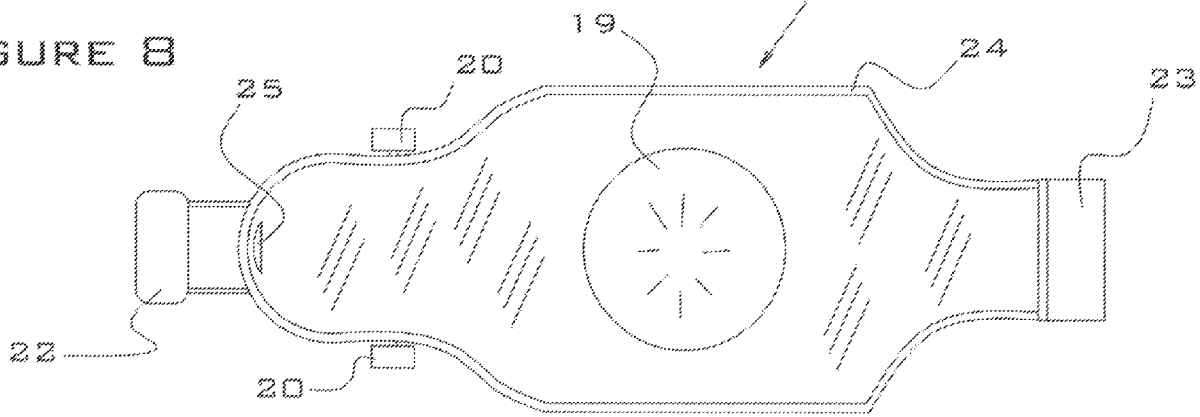
FIG. 8 is an overhead view of the second embodiment of the present invention, shown with the camouflage shroud removed for clarity.
Figure 16:
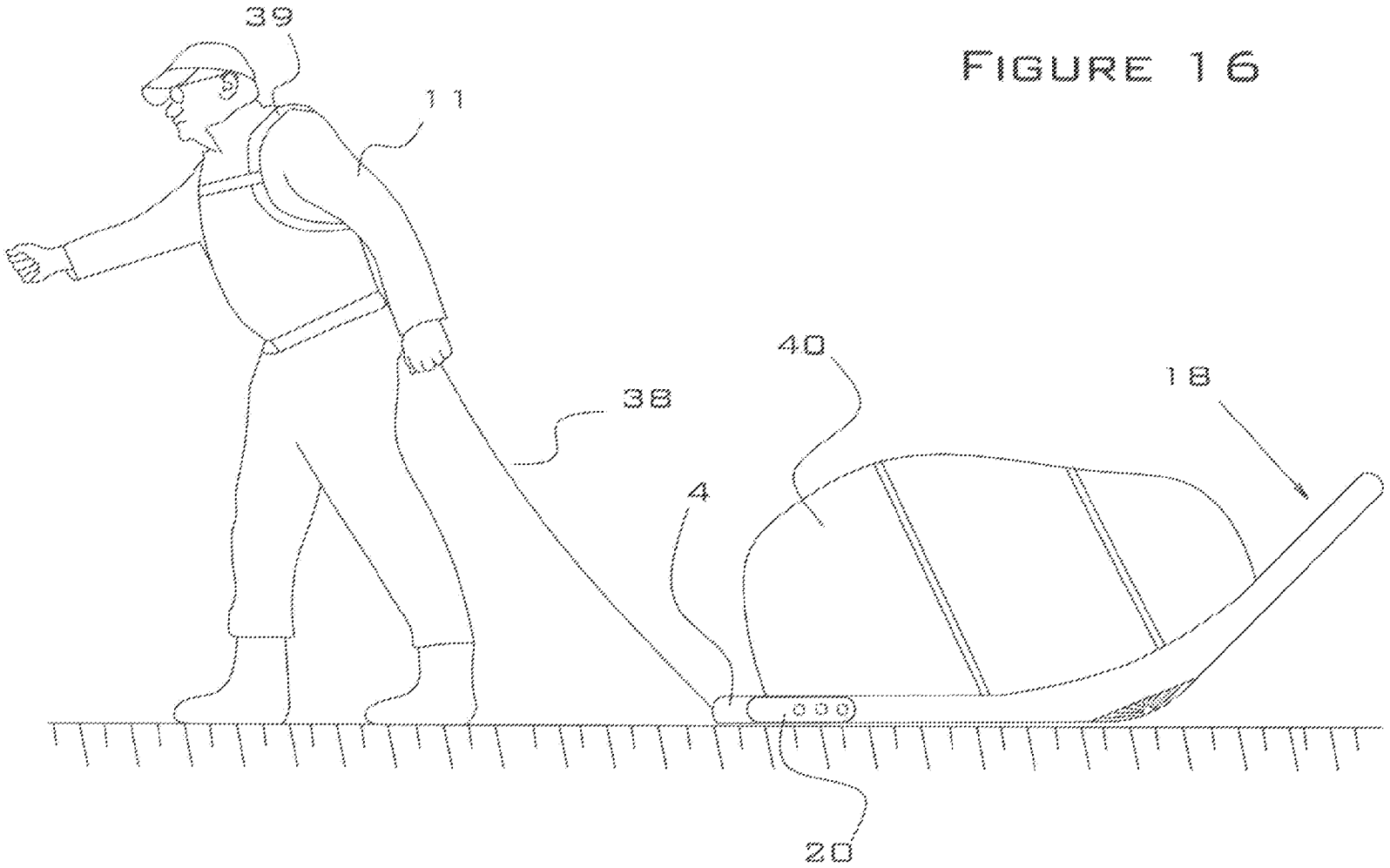
FIG. 16 is an illustration of the second embodiment of the present invention flipped so that the seatback portion is flat on the ground surface.

In FIGS. 7-9, the rotatable stop legs 20 are shown in the positions in which the invention 18 is deployed for hunting (i.e., the long axes of the legs 20 are perpendicular to the long axis of the seatback portion 3). The stop legs 20 may be rotated ninety (90) degrees (as shown in FIG. 16) when the second embodiment 18 is flipped on its back for transport, enabling the second embodiment 18 to be slid across the ground surface with the back side (i.e., the underside) of the seatback portion 4 in contact with the ground surface. The storage bag 23 may be attached with straps (not shown) to the terminal end of the leg rest portion 3 of the invention 18. When the storage bag 23 is filled with objects such as shotgun ammunition, the weight of the objects causes the center of gravity of the invention to shift forward, thereby making it more easily rocked from the reclining to the sitting position. Although the storage bag 23 is shown in conjunction with the second embodiment 18 in FIGS. 7 and 8, the storage bag may be used in conjunction with any of the three embodiments of the present invention.

FIG. 8 is an overhead view of the second embodiment 18 of the present invention shown in FIG. 7. As shown, the outer perimeter of the second embodiment 18 is anatomically shaped to fit the hunter; that is, it is wider where it supports the back and trunk of the hunter and narrower where it supports the head and legs of the hunter. This anatomical shape allows the second embodiment 18 to be smaller and easier to transport, and also cheaper to manufacture, by optimising material use. The narrow section that supports the legs of the hunter also allows the hunter's legs to more easily be placed to the sides of the invention when it is in the reclined position, resulting in added comfort for the hunter when recurring and added speed for the hunter when his legs are brought together for rising from an inclined to sitting position. Note that the first and third embodiments may also incorporate a similar anatomical shape.

FIG. 8 also shows an optional thickened section that forms a perimeter lip 24 that may be molded into the second embodiment 18. This lip 24 provides additional strength and stiffness to the second embodiment 18 with minimal addition of weight. The lip may be extended to any desired height; for example, a height of one (1) inch may be sufficient to provide structural stiffness to the second embodiment, while an extended height of six (6) inches may be useful to provide side rails that may be used by the hunter for support when entering or departing from the second embodiment. A hand hole 25 is provided to aid in lifting or sliding the device. The second embodiment 18 may comprise optional molded-in sled runners (shown in FIGS. 17 and 18) that run longitudinally along a portion of the underside surface of the leg rest portion and/or seatback portion of the second embodiment 18.

FIG. 9 is a cross-section view of the second embodiment 18 at the section shown in FIG. 7. FIG. 9 shows the shape and positions of the rotatable stop legs 20 when deployed in the down or hunting position. Each stop leg 20 is attached to the second embodiment 18 by a bolt 26 that passes through one of multiple holes 27 in the stop leg 20. The stop legs 20 may be adjusted for height to fit the preference of an individual hunter by moving the bolts 26 to another pair of holes 27 in the stop legs 20.

FIG. 10 is a cross-section view of the second embodiment 18 at the section shown in FIG. 7. FIG. 10 shows the shape of the seat indentation 19, swivel maker 21, and perimeter lip 24.

Figure 11:
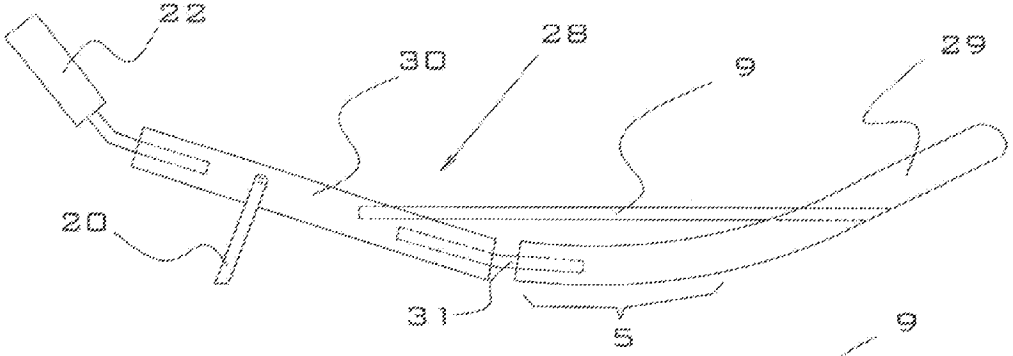
FIG. 11 is a side view of the third embodiment of the present invention, shown with the shroud omitted for clarity.

FIG. 11 is a side view of the third embodiment 25 of the present invention, shown with the shroud omitted for clarity. The third embodiment 28 comprises a molded polymer leg rest component 29, a molded polymer seatback component 30, connecting rods 31, rotatable stop legs 20, an optional adjustable headrest 22, and optional side supports 9. The connecting rods 31 and optional side supports 9 fit into inserts that are molded into the leg rest 29 and seatback 30. The leg rest 29 comprises a molded seat indentation 19 and a rocker portion 5. Alternately, the leg rest 29 may comprise a bowl-shaped swivel rocker 21 (as shown in FIG. 7) instead of a rocker portion 5.

The leg rest 29 and seatback 30 are preferably comprised of injection-molded thermoplastic such as low-density polyethylene, high-density polyethylene, or polypropylene. In an alternate embodiment, the leg rest 29 and seatback 30 may be comprised of thermoset polymer such as urethane or polyurethane. In yet another alternate embodiment, the leg rest 29 and the seatback 30 may comprised of hollow rotation-molded or blow-molded thermoplastic, such as low-density polyethylene, high-density polyethylene, or polypropylene, that is filled with thermoset polymer foam such as polyurethane foam. The connecting rods are preferably comprised of rectangular or round aluminum or steel tubing. The third embodiment may comprise optional molded-in sled runners that run longitudinally along a portion of the underside of the leg rest 29 and/or the seatback 30.

Figure 12:
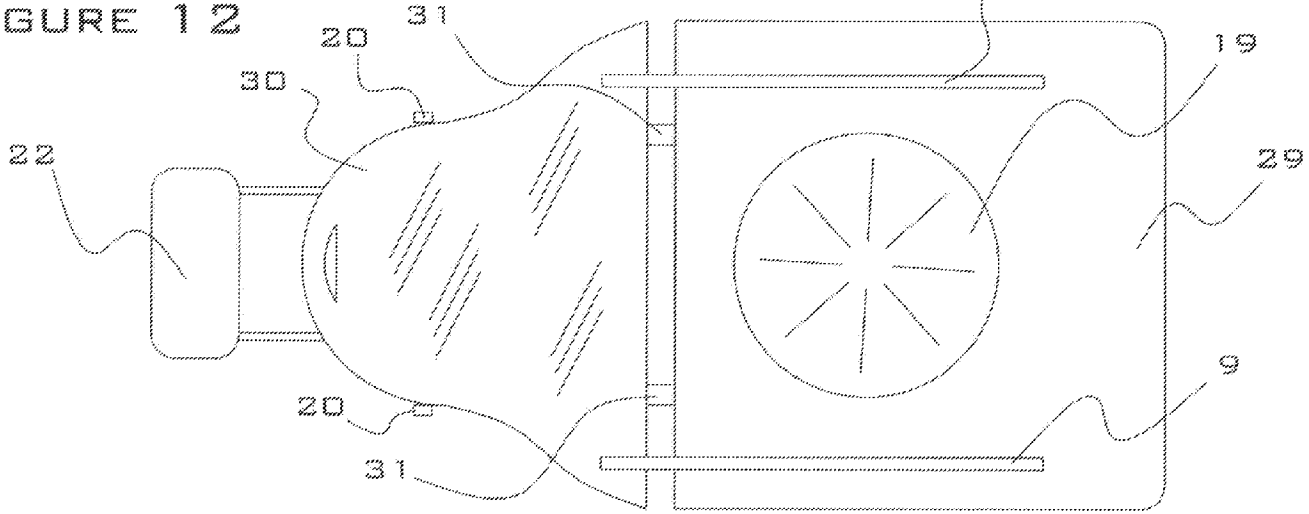
FIG. 12 is an overhead view of the third embodiment of the present invention, shown with the shroud omitted for clarity.

FIG. 12 is an overhead view of the third embodiment 28 of the present invention shown in FIG. 11. Preferably, the seat indentation 19 is formed so as to be very smooth, thereby minimizing friction between the indentation and the hunter's pants, which allows the hunter to rotate easily in the seat indentation 19.

Figure 13:
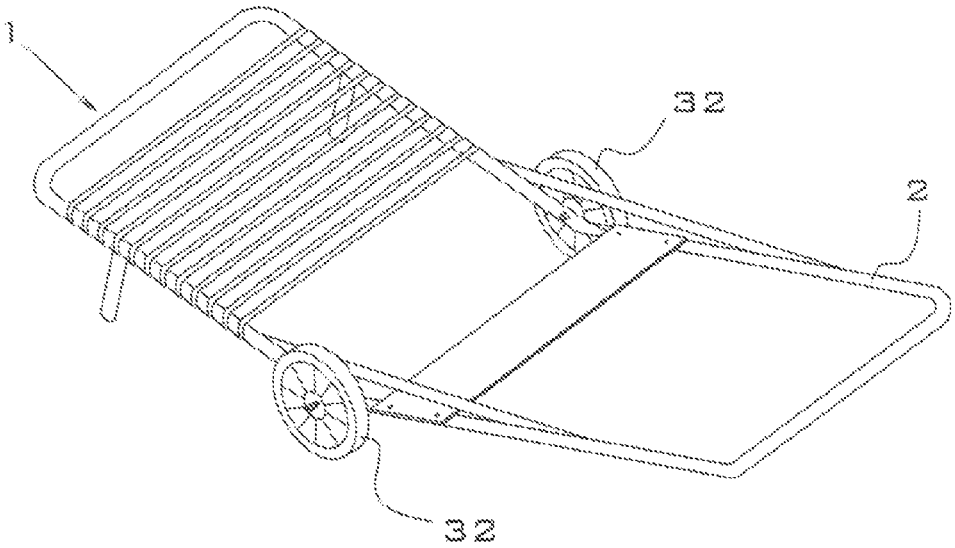
FIG. 13 is a perspective view of the first embodiment of the present invention equipped with optional removable wheels, shown with the shroud removed for clarity.

FIG. 13 is a perspective view of the first embodiment 1 of the present invention, shown with the shroud removed tor clarity, and equipped with optional removable wheels. As shown in FIG. 13, one wheel assembly 32 is attached to each side of the framework 2 near the center of balance of the present invention. With the wheel assemblies 32 attached, the hunter may load hunting equipment onto the present invention and then roll it to and from the hunting location, either by pushing the present invention like a grocery cart or by pulling it like a wagon. Although FIG. 13 Illustrates the optional wheel assemblies 32 used in combination with the first embodiment 1 of the present invention, the optional wheel assemblies 32 are equally compatible with the second 18 and third 28 embodiments of the present invention.

Figure 14:
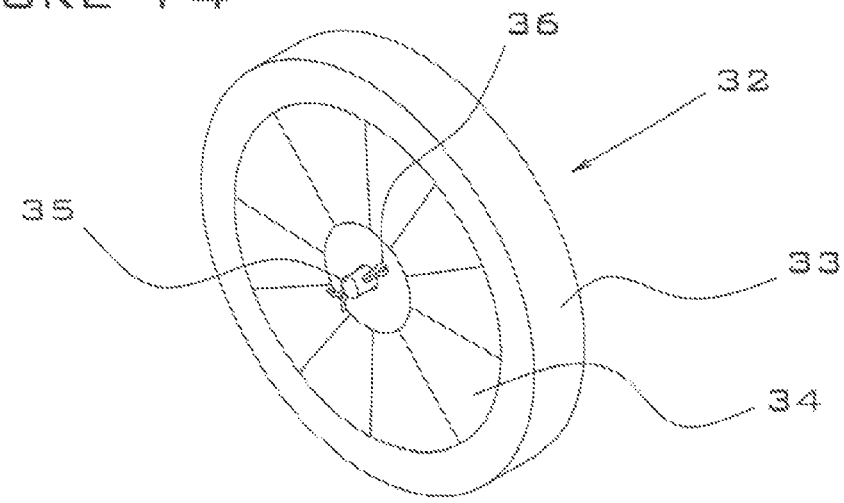
FIG. 14 is a detail view of the optional wheel assembly.

FIG. 14 is a detail view of an optional wheel assembly 32, which is comprised of a rubber tire 33, a polymer or metal rim 34, a metal axle 35, and a metal cotter pin 36. The cotter pin 36 is installed in a hole through the axle 35 as shown. For the first embodiment 1, the axles 35 are welded to the metal framework 2. For the second 18 and third 28 embodiments, the axles 35 are inserted into holes that are molded into the edges of the polymer frames (not shown). The tires 33 and rims 34 may be removed from the axles 35 by pulling the cotter pins 36 out of holes and sliding each rim 34 off its axle 35.

Figure 15:
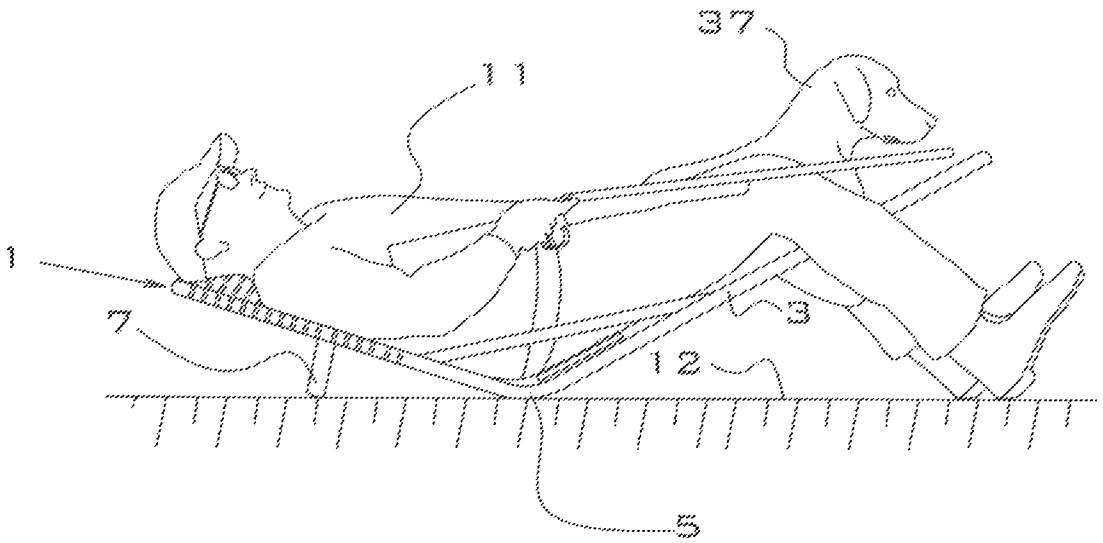
FIG. 15 is a side view of the first embodiment of the present invention used by a hunter and an optional hunting dog, shown with the hunter in a reclining position, and with the camouflage shroud of the invention removed for clarity.

FIG. 15 is a side view of the first embodiment of the invention used by a hunter and an optional hunting dog, shown with the hunter in a reclining position, and with the camouflage shroud of the invention removed for clarity. As shown, the dog 37 lies between the legs of the hunter 11 while awaiting game, with the dog 37 positioned on the leg rest portion 3 of the first embodiment 1 of the present invention. In this example, the leg rest portion 3 of the present invention has been extended (compared to the leg rest portion shown in FIG. 2) to provide adequate space for the dog 37.

FIG. 16 illustrates a method of pulling the second embodiment 18 of the present invention like a sled over snow or smooth ground. As shown in FIG. 16, the second embodiment 18 is flipped so that the seatback portion 4 is flat on the ground surface. One end of a tow rope 38 is attached to the terminal end of the seatback portion 4, and the other end of the tow rope 38 is attached to a pair of shoulder straps 39 that are worn by a hunter 11. Also shown is an equipment bag 40 (which may contain supplies such as decoys and ammunition) that is strapped to the second embodiment 18 and transported to and from the hunting location. The second embodiment 18 shown in FIG. 16 is equipped with stop legs 20 that are rotatable, and these stop legs 20 are shown rotated into a position parallel with the ground surface so that they do not drag along the ground when the second embodiment 18 is pulled. The third embodiment 28 may be towed in a similar manner to the method illustrated in FIG. 16 for the second embodiment 18.

Figure 17:
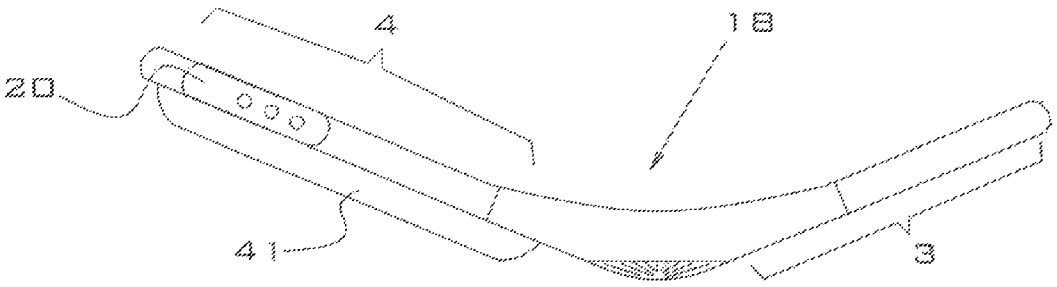
FIG. 17 is a side view of the second embodiment of the present invention shown with molded-in sled runners.
Figure 18:
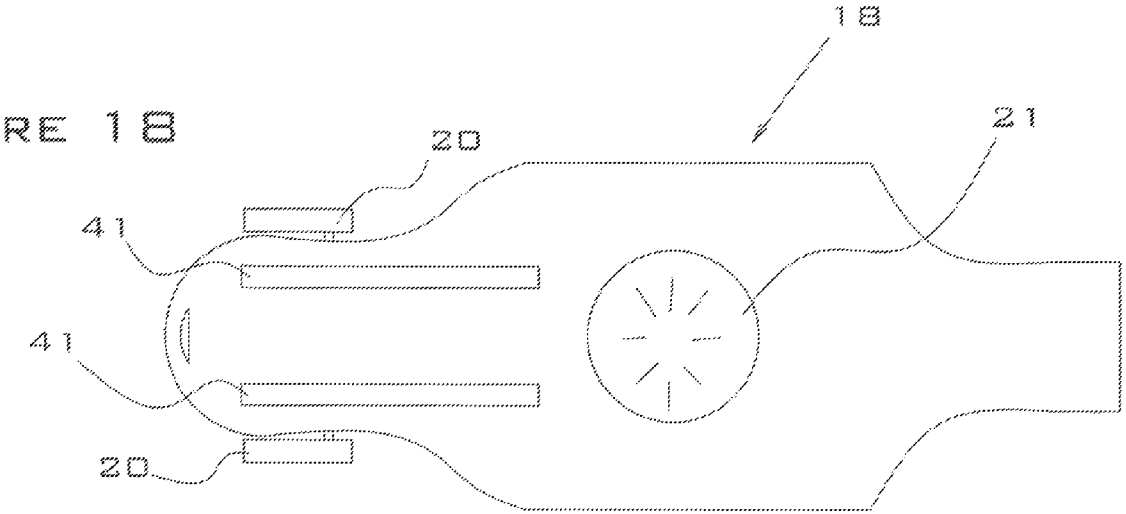
FIG. 18 is a bottom view of the second embodiment of the present invention shown with molded-in sled runners.

FIGS. 17 and 18 are side and bottom views, respectively, of the second embodiment 18 of the present invention shown with optional molded-in sled runners 41. As shown in FIGS. 17 and 18, the rotatable stop legs 20 have been rotated into orientations parallel with the edge of the seatback portion 4, thereby preventing the stop legs 20 from contacting the ground surface when the second embodiment 18 is flipped over and pulled like a sled, as shown in FIG. 16. Note that the optional sled runners might be preferred in locations where snow is hard-packed or icy, while pulling the second embodiment 18 without the optional sled runners might be preferred where snow is soft and deep. The optional molded-in sled runners 41 are also suitable for use with the third embodiment 28.

We claim:

1. A hunting blind comprising:

a molded polymer unit comprising a substantially straight leg rest portion, a substantially straight seatback portion, a molded swivel rocker, a rounded portion defining a molded seat indentation, and a rectangular frame having a long axis with a midpoint at the rounded portion, the frame being bent at or near the midpoint of the long axis to form the leg rest portion;

a first rotatable lea attached to the seatback portion and a second rotatable lea attached to the seatback portion;

wherein the leg rest portion, the seatback portion, the swivel rocker and the seat indentation are manufactured as a single continuous component;

wherein the swivel rocker is bowl-shaped such that the swivel rocker rests on a ground surface;

wherein the leg rest portion and the seatback portion are inclined at approximately equal angles in relation to the ground surface such that they form a V-shape; and wherein the molded polymer unit has a reclining position in which the seatback portion is substantially parallel to the ground surface and a sitting position in which the leg rest portion is substantially parallel to the ground surface and is moveable from the reclining position to the sitting position by a rocking movement of the user shifting the center of gravity of the molded polymer unit from the seatback portion to the leg rest portion.

2. The hunting blind of claim 1, wherein the first and second stop legs are configured to rotate ninety degrees.

3. The hunting blind of claim 1, further comprising an adjustable headrest.

4. The hunting blind of claim 1, wherein an outer perimeter of the hunting blind is anatomically shaped to fit a hunter.

5. The hunting blind of claim 1, further comprising a lip that extends upward from and around a perimeter of the hunting blind.

6. The hunting blind of claim 1, further comprising molded-in sled runners that extend longitudinally along a portion of an underside surface of the leg rest portion.

7. The hunting blind of claim 1, further comprising molded-in sled runners that extend longitudinally along a portion of an underside surface of the seatback portion.

8. The hunting blind of claim 1, further comprising a shroud that covers the hunting blind, wherein the shroud is of a freeform shape, wherein an outer surface of the shroud is comprised of camouflage fabric, and wherein the shroud comprises a face hole, a right gun slot, and a left gun slot.

9. The hunting blind of claim 1, further comprising a storage bag that is attached with straps to a terminal end of the leg rest portion.

10. The hunting blind of claim 1, wherein the first and second stop legs are adjustable in height.

11. The hunting blind of claim 1, further comprising a first removable wheel assembly and a second removable wheel assembly;

wherein the first removable wheel assembly is attached to a first side of the hunting blind, and the second removable wheel assembly is attached to a second side of the hunting blind;

wherein the hunting blind has a center of balance; and wherein the first and second wheel assemblies are attached proximate to the center of balance.

12. The hunting blind of claim 1, wherein the swivel rocker is comprised of a polymer material having a coefficient of friction of about 0.3 or less against packed sand, a Shore D hardness of at least D69, and a tensile strength of at least 4600 pounds per square inch.

13. The hunting blind of claim 1, wherein the frame is bent at an angle of between 100 degrees and 160 degrees.

14. The hunting blind of claim 13 wherein the frame is bent at an angle of about 135 degrees.

15. The hunting blind of claim 13 wherein when the molded polymer unit is in a fully upright position the leg rest portion is substantially parallel with the ground surface and the seatback portion is at an angle of about 45 degrees in relation to the ground surface.

* * * * *